US008375606B2

(12) United States Patent
Ford

(10) Patent No.: US 8,375,606 B2
(45) **Date of Patent: *Feb. 19, 2013**

(54) POST-PULLER AND METHOD

(76) Inventor: Thomas Ford, Lake Kiowa, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/461,413

(22) Filed: May 1, 2012

(65) Prior Publication Data

US 2012/0210610 A1 Aug. 23, 2012

Related U.S. Application Data

(63) Continuation of application No. 13/150,512, filed on Jun. 1, 2011, now Pat. No. 8,166,676, which is a continuation of application No. 12/422,604, filed on Apr. 13, 2009, now Pat. No. 7,963,051.

(51) Int. Cl.
*E02F 1/00* (2006.01)

(52) U.S. Cl. ..... 37/195

(58) Field of Classification Search ..... 37/195, 37/466; 254/29–31, 131, 132, 133; 294/91, 294/92, 102 R, 106, 113
See application file for complete search history.

(56) References Cited

U.S. PATENT DOCUMENTS

| | | | |
|---|---|---|---|
| 2,807,494 | A | 9/1957 | Bulfer, Jr. |
| 3,762,687 | A | 10/1973 | De Rome et al. |
| 4,040,601 | A | 8/1977 | Boardman |
| 4,226,402 | A | 10/1980 | Muth |
| 4,422,621 | A | 12/1983 | Ekern |
| 4,721,335 | A | 1/1988 | Krenek, Jr. |
| 4,738,433 | A | 4/1988 | Hoff |
| D312,196 | S | 11/1990 | Norona |
| 5,011,117 | A | 4/1991 | Youngblood et al. |
| 5,052,659 | A | 10/1991 | Bates |
| 5,186,437 | A | 2/1993 | Scott |
| 5,368,277 | A | 11/1994 | Moss |
| 6,056,271 | A | 5/2000 | Riojas |
| 6,367,779 | B1 | 4/2002 | Martin et al. |
| 6,669,172 | B1 | 12/2003 | Bearden |
| 7,059,587 | B1 | 6/2006 | Fimple |
| 7,185,880 | B1 | 3/2007 | McCray |
| 7,290,754 | B2 | 11/2007 | Mensi et al. |

OTHER PUBLICATIONS

SpeeCo Tractor-Mounted T-Post Puller, Model#16110800; Northern Tool + Equipment; retrieved from internet on Feb. 24, 2009; <http://www.northerntool.com/webapp/wcs/stores/servlet/product_6970_200347870_200347870>.

RR T-Post Puller, RR#91375; Red Rooster Ag Products; original publication date unknown, retrieved from Internet on Aug. 6, 2009; <http://www.redroosterag.com/SuperStore/SuperStore-Product.asp?ProductID=166>.

*Primary Examiner* — Robert Pezzuto
(74) *Attorney, Agent, or Firm* — Howison & Arnott, L.L.P.

(57) ABSTRACT

A method of removing a T-type fence post from the earth with a powered, mobile piece of equipment controlled by a human operator includes attaching a substantially flat plate to a lift arm of the powered, mobile piece of equipment such that the plate hangs substantially vertically from the lift arm and can move in an arc, the plate having an opening with a top wall and a bottom wall, moving the powered, mobile piece of equipment in a first direction to pull the plate over the fence post such that an upper portion of the post enters the opening with the bottom and upper walls of the opening engaging the post with sufficient force to retain the post in the opening when the post is pulled from the earth and raising the lift arm to pull the post from the earth in a substantially vertical direction.

15 Claims, 6 Drawing Sheets

POST-PULLER AND METHOD

CROSS-REFERENCE TO RELATED APPLICATIONS

This application is a continuation of U.S. patent application Ser. No. 13/150,512, filed Jun. 1, 2011, published as U.S. Publication No. 2011-0227013 on Sep. 22, 2011, issued as U.S. Pat. No. 8,166,676 on May 1, 2012, and entitled POST-PULLER AND METHOD application Ser. No. 13/150,512 is a continuation of U.S. patent application Ser. No. 12/422,604, filed Apr. 13, 2009, published as U.S. Publication No. 2010-0260590 on Oct. 14, 2010, issued as U.S. Pat. No. 7,963,051 on Jun. 21, 2011, and entitled POST-PULLER AND METHOD U.S. Publication Nos. 2011-0227013 and 2010-0260590 and U.S. Pat. Nos. 8,166,676 and 7,963,051 are incorporated herein in their entirety.

TECHNICAL FIELD

This disclosure relates to an apparatus and method for removing fence posts and other elongate objects embedded in the earth with a mobile vehicle such as a tractor, backhoe or front end loader having a lift arm. In one embodiment, the method is accomplished without the operator of the vehicle mounting or dismounting the vehicle to engage the apparatus with the elongate object.

BACKGROUND

Referring to FIGS. 1A and 1B, a T-type fence post 100 is a type of steel fence post having a T-shaped cross-section including a cross bar 102 and a flange 104 with a row of studs or hooks 106 projecting from the flat side of the crossbar for attaching wire fencing. T-type fence posts may be provided with one or more anchors 108 to aid in securing the post in the earth. T-type fence posts are generally less costly and easier to install than wooden or pipe posts. T-type fence posts may be installed manually, typically with a piece of steel pipe having one closed end and having handles on the sides of the pipe for lifting the pipe. The open end of the pipe is placed over the pipe and the pipe dropped to drive the post into the ground. Weights may be attached to the pipe to increase the force of the impact when the pipe is dropped on the T-type fence post. Other types of tools may be also be used to drive the posts into the earth.

Removing T-type fence posts, as well as wooden and pipe-type posts, may, however, be difficult, particularly when the posts have been in the ground for an extended period. Considerable force may be required to extract the posts from the earth due to compaction of the soil around the posts and surface corrosion of the posts. Typically, a chain, cable or rope is tied to the post and attached to a front end loader, tractor, backhoe or other piece of engine powered mobile equipment or vehicle that is used to pull the post from the ground. However, the chain cable or rope may slip off the post and/or the post may be bent or broken to the point that it cannot be re-used.

Further, the operator of the mobile equipment or vehicle must dismount to wrap the chain or cable around each post, remount the tractor to pull the post, dismount the tractor to remove the chain or cable from the post and then remount the tractor proceed to the next post. Alternatively, a helper must be employed to attach the cable or chain to the post. If the chain or cable slips off the post the operator must dismount re-position the chain or cable and remount the tractor or other piece of mobile equipment. As will be appreciated, if a large number of posts are to be pulled, this can be a time consuming and labor intensive process.

Manual post pulling devices similar to jacks may be used to pull posts from the earth, but these tools normally require even more labor and time. Devices that use hydraulically powered jaws to grip and pull posts may also be used, however, these tend to be expensive and typically must be mounted on a piece of mobile equipment. Consequently there is a need for a method of pulling T-type posts and other similar elongate rigid objects from the earth that is simple, inexpensive, and quick and that reduces the amount of physical labor involved in the process.

As used herein, a powered piece of mobile equipment or vehicle refers to a front end loader, tractor, backhoe or other piece of powered mobile equipment or vehicle having a hydraulically actuated lift arm wherein a human operator rides on the vehicle to steer and control the operation of the piece of equipment or vehicle, including the lift arm.

SUMMARY

In one aspect, a method of removing a T-type fence post embedded in the earth with a powered, mobile piece of equipment controlled by a human operator, wherein a portion of the fence post projects from the earth, and includes attaching a substantially flat plate to a lift arm of the powered, mobile piece of equipment such that the plate hangs substantially vertically from the lift arm and can move in an arc, the plate having an opening therethrough, the opening having a top wall and a bottom wall. The plate may be connected to the lift arm of the powered, mobile piece of equipment with one of a chain, cable or rope such that the plate may move in an arc beneath the lift arm.

The powered, mobile piece of equipment is moved into proximity with the T-type fence post such that the opening of the plate is adjacent an upper end of the T-type fence post. The powered, mobile piece of equipment is then moved in a first direction to pull the plate over the T-type fence post such that the plate moves over the T-type fence post and an upper portion of the T-type fence post enters the opening and projects through the opening with the bottom wall of the opening adjacent the cross-bar of the T-type fence post.

The bottom wall of the opening is engaged with a stud projecting from the cross bar of the T-type fence post with the upper wall of the opening engaging the flange of the T-type fence post with sufficient force to retain the post in the opening when the post is pulled from the earth. The lift arm is then raised to pull the post in a substantially vertical direction to extract the fence post from the earth.

In one variation, the powered, mobile piece of equipment is moved in a reverse direction, opposite the first direction, after engaging the stud such that the lower wall of the opening engages the cross bar of the T-type fence post and the upper wall engages the flange of the post with sufficient force to retain the T-type fence post in the opening when the post is pulled from the earth.

In one embodiment, the T-type fence post may be disengaged from the plate by lowering the lift arm such that a lower end of the T-type fence post contacts the earth and then moving the powered, mobile piece of equipment in a reverse direction to disengage the post from the opening in the plate. As will be appreciated, the foregoing method may be practiced without the operator of the piece of mobile equipment dismounting from the piece of equipment to attach a chain, cable, rope or other device to the fence post.

In another aspect, a rigid elongate object such as a wooden or steel fence post, tree trunk or similar object is removed from the earth with a powered mobile vehicle controlled by a human operator. The method includes attaching a substantially flat plate to a hydraulically operated lift arm of the powered, mobile vehicle with one of a chain, cable or rope such that the plate hangs vertically from the lift arm and can move in an arc. The plate has an opening therethrough, with the opening having a top wall and a bottom wall. The powered mobile vehicle is moved into proximity with the rigid elongate object such that the opening of the plate is adjacent an upper end of the rigid elongate object. The powered mobile vehicle is then moved in a first direction to pull the plate over the rigid elongate object with an upper portion of the rigid elongate object entering the opening and projecting through the opening.

A first side of the rigid elongate object is engaged with the bottom wall of the opening and a second, opposed side of the rigid elongate object is engaged with the upper wall of the opening. The bottom wall and the upper wall engage the rigid elongate object with sufficient force to retain the object in the opening when the object is pulled from the earth by raising the lift arm. In one variation, the powered mobile vehicle is moved in a reverse direction after engaging the rigid elongate object such that the lower wall of the opening engages a first side of the rigid elongate object and the upper wall engages an opposed, second side of the rigid elongate object with sufficient force to retain the rigid elongate object in the opening when the object is pulled from the earth. To disengage the object after it is pulled from the earth, the lift arm may be lowered and the vehicle moved in the reverse direction.

BRIEF DESCRIPTION OF THE DRAWINGS

For a more complete understanding, reference is now made to the following description taken in conjunction with the accompanying Drawings in which.

DETAILED DESCRIPTION

Figure 3:
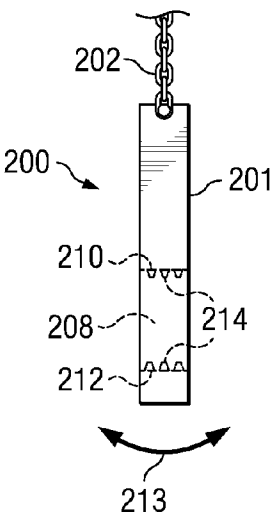
FIG. 3 is a side view of the post-pulling apparatus of FIG. 2.

Referring now to the drawings, wherein like reference numbers are used herein to designate like elements throughout, the various views and embodiments of a post-puller and method are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Figure 2:
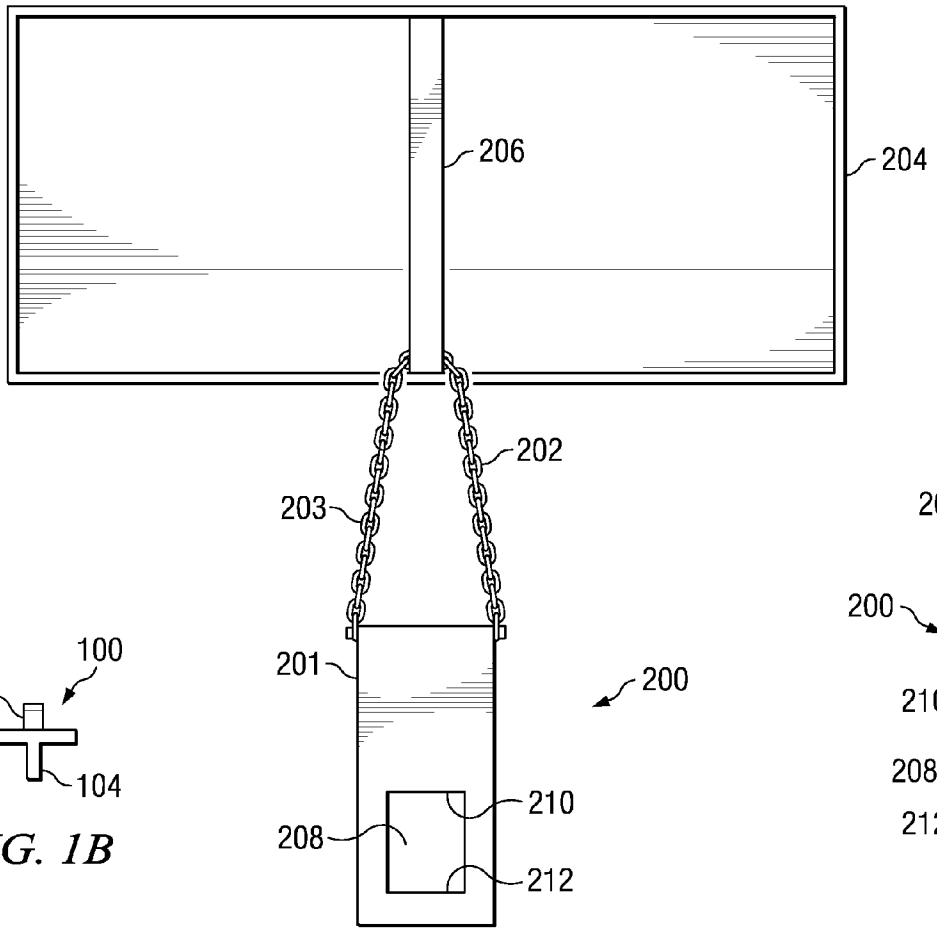
FIG. 2 is a front view of a post-pulling apparatus used in one method described herein.

FIG. 2 is a front view of a post pulling apparatus 200 attached to the bucket 204 of a tractor or front-end loader. As illustrated, apparatus 200 includes a chain 202 for attaching the apparatus to a cross-member or brace 206 of bucket 204. Apparatus 200 includes a substantially flat plate 201 having a rectangular opening 208 with an upper wall 210 and a lower wall 212. In one variation, chain 202 has an odd number of links 203 such that a center link of the chain can be positioned against brace 206 to insure that plate 201 hangs from bucket 204 with upper wall 210 and lower wall 212 substantially horizontal to the earth.

Figure 4:
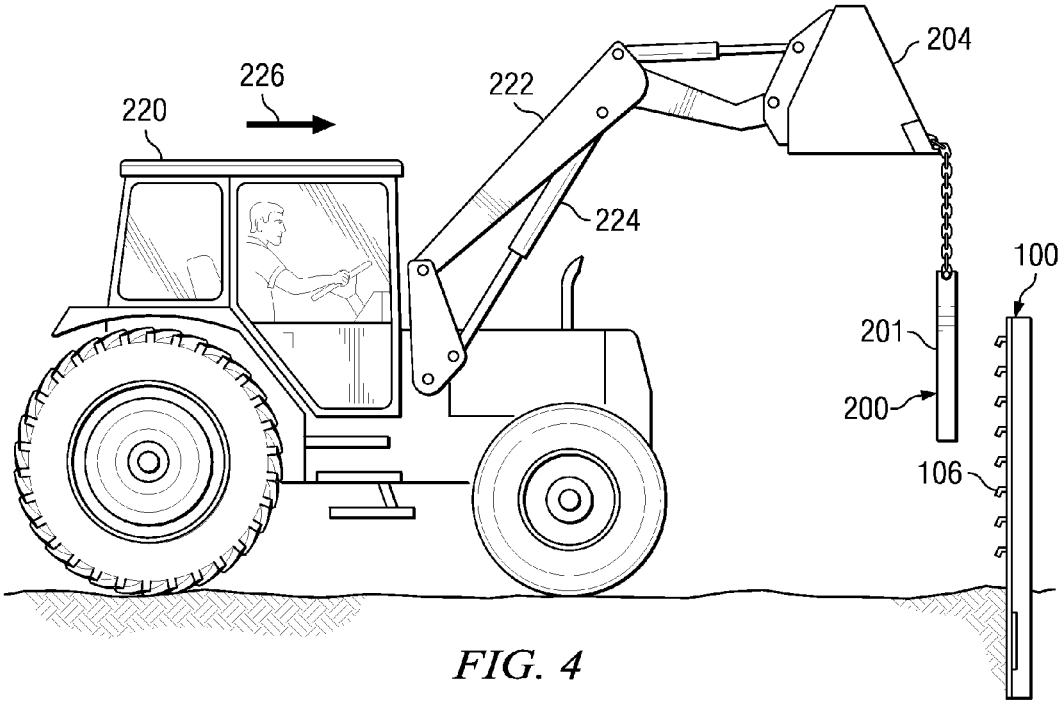
FIGS. 4-7 illustrate initial steps of a method of pulling a fence post from the earth as described herein.

FIG. 3 is a side view of the post-pulling apparatus of FIG. 2. Referring to FIGS. 2-4, in one embodiment, chain 202 is used to hang plate 201 from the lift-arm of a piece of mobile equipment, such as a tractor 220, front-end loader, backhoe or another piece of mobile equipment with a hydraulically actuated lift-arm. In other embodiments, a cable or rope may be substituted for chain 202. When attached to a piece of mobile equipment in this manner, plate 201 is free to move in arc generally indicated with arrow 213 of FIG. 3. As best shown in FIG. 3, upper and lower walls 210, 212 of opening 208 may be provided with teeth 214 or similar serrations or projections to facilitate engagement with a fence post or similar elongate rigid object having a first end embedded in the earth and a second end projecting out of the earth.

Figure 1B:
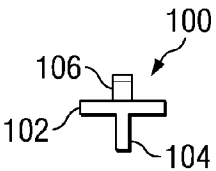
FIG. 1B is a cross-sectional view of the T-type fence post of FIG. 1A.

FIG. 4 is a side view illustrating the first step in a method according to the invention. As shown, a tractor or front-end loader 220 has a lift-arm 222 with a bucket 204 mounted thereon. Lift-arm 222 is actuated with a hydraulic cylinder 224 for movement up and down in a vertical direction. Post-pulling apparatus 200 has been connected to the bucket such that plate 201 is free to move in an arc as illustrated in FIG. 3. The operator of tractor 220 moves the tractor in the direction indicated by arrow 226 and positions lift arm 222 and bucket 204 such that the opening 208 in plate 201 is adjacent the upper end of a T-type fence post 100. Plate 201 is positioned such that the plate is on the cross-bar side of post 100 where studs 106 extend from the cross-bar 102 of the post (FIG. 1B).

Figure 5:
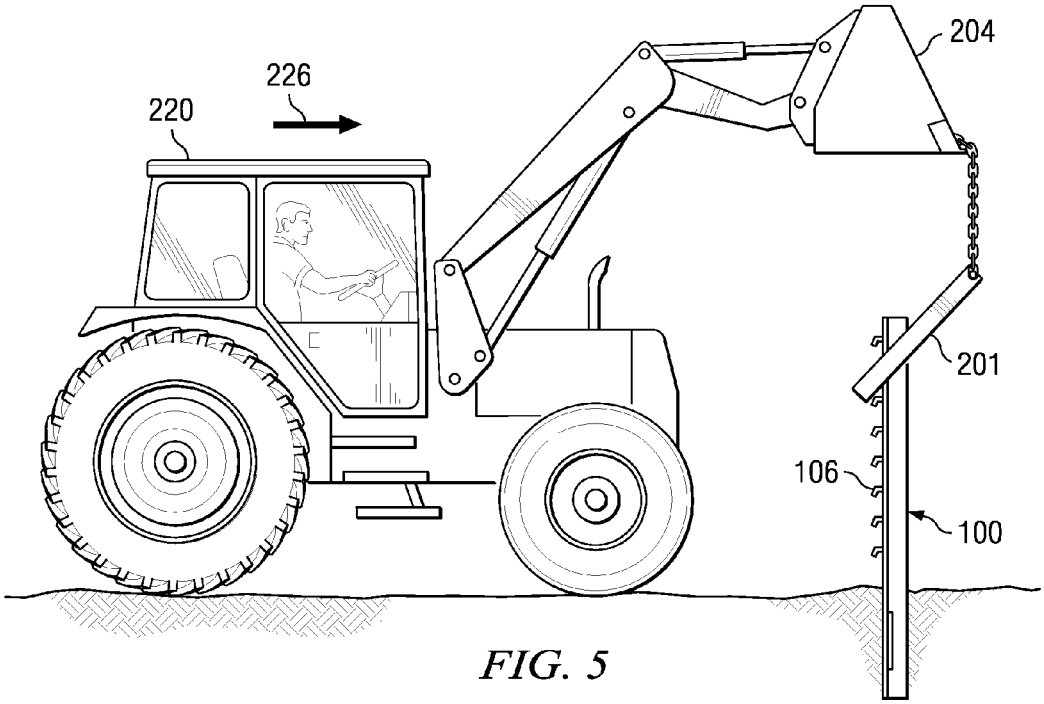
Figure 6:
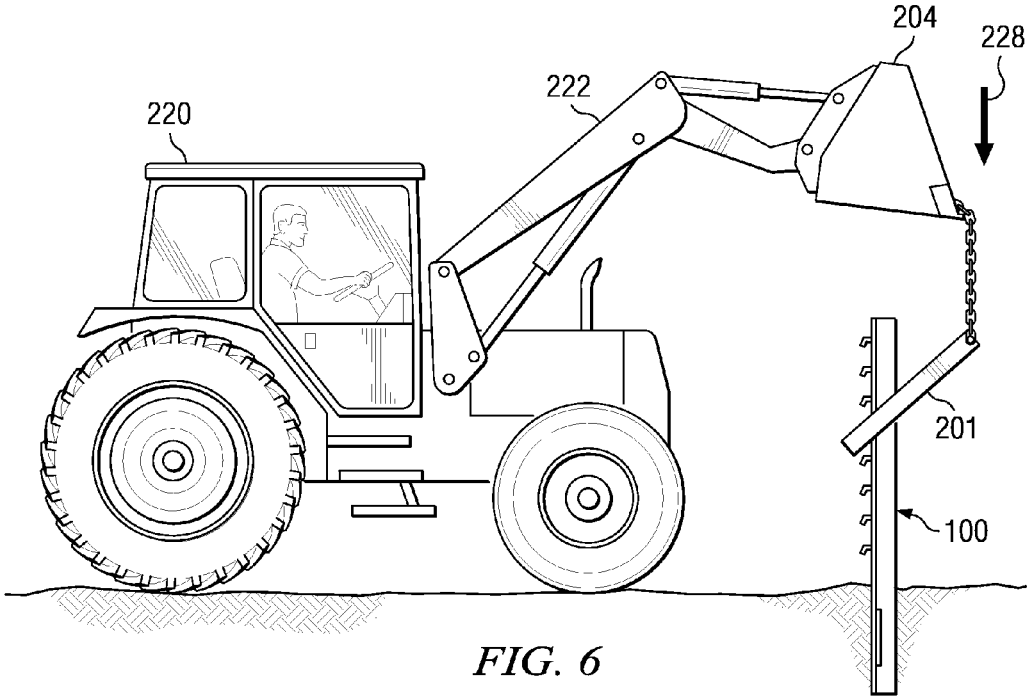

Referring now to FIG. 5, the operator of tractor 220 continues to move the tractor in the direction indicated by arrow 226 until the upper end of T-type post 100 is engaged in opening 208 of plate 201. As illustrated, plate 201 is moved or dragged over the post in a direction so that the bottom wall of opening 208 is on the side of cross-bar 102 where studs 106 project from the post. In order to position plate 108 in this manner, the plate should be free to move in an arc as it engages the post. Turning to FIG. 6, the operator of tractor 220 then lowers lift-arm 222 and bucket 204 such that plate 201 slides down post 100 under the force of gravity. Plate 201 is lowered to a position where bottom wall 212 of opening 208 is past at least the upper one of studs 106 with the upper wall 210 against flange 104 of post 100.

Figure 1A:
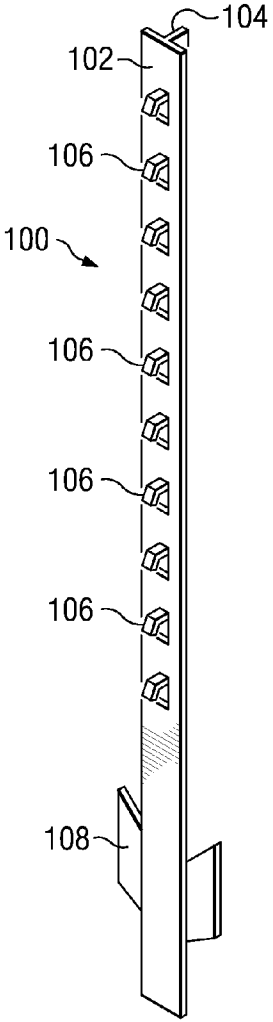
FIG. 1A is a side view of a T-type fence post.
Figure 7:
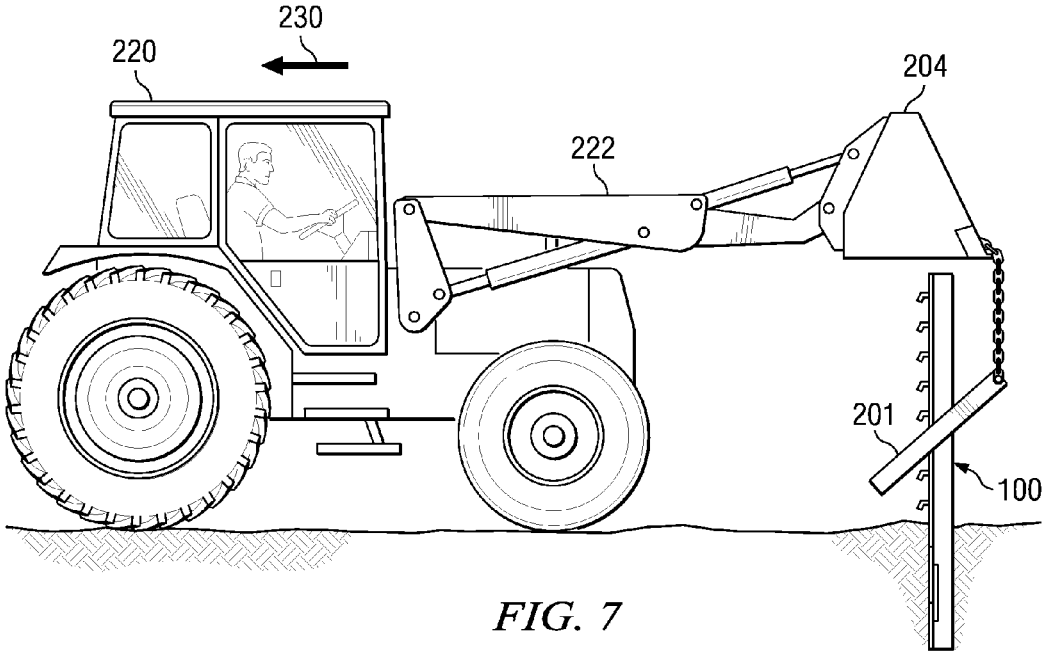
Figure 8:
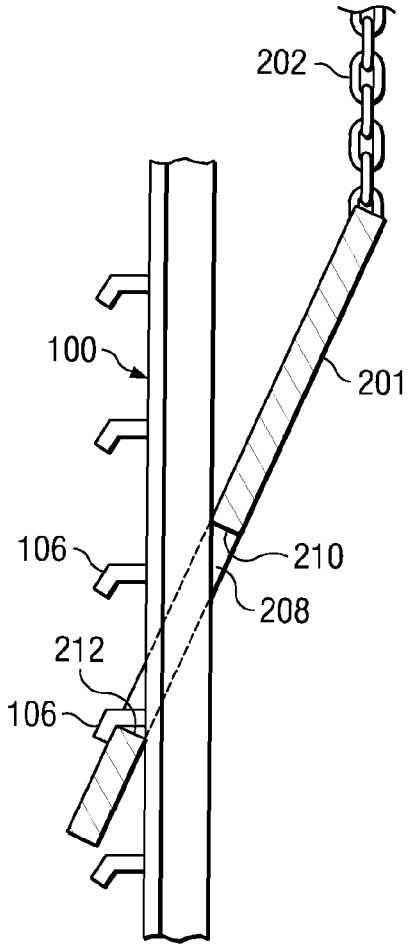
FIG. 8 is a partial perspective view of the post-pulling apparatus of FIGS. 2 and 3 engaged with a T-type fence post.

Referring now to FIG. 7, after plate 201 is positioned at the desired height on T-type post 100 the operator of tractor 220 may then move the tractor in a reverse direction as indicated by arrow 230. This, in turn, causes plate 201 to engage post 100 as illustrated in FIG. 8. At this point, the bottom wall 212 of opening 208 is engaged with one of studs 106 of T-type post 100 while the top wall 210 of the opening engages the opposing side, (e.g. flange 104 of FIGS. 1A, 1B) of the post. In some instances, it may not be necessary to move tractor 220 in a reverse direction to accomplish this step. In other variations, bucket 204 of tractor 220 may be tilted and/or raised to cause plate 201 to engage T-type post 100 as illustrated in FIG. 8.

Figure 9:
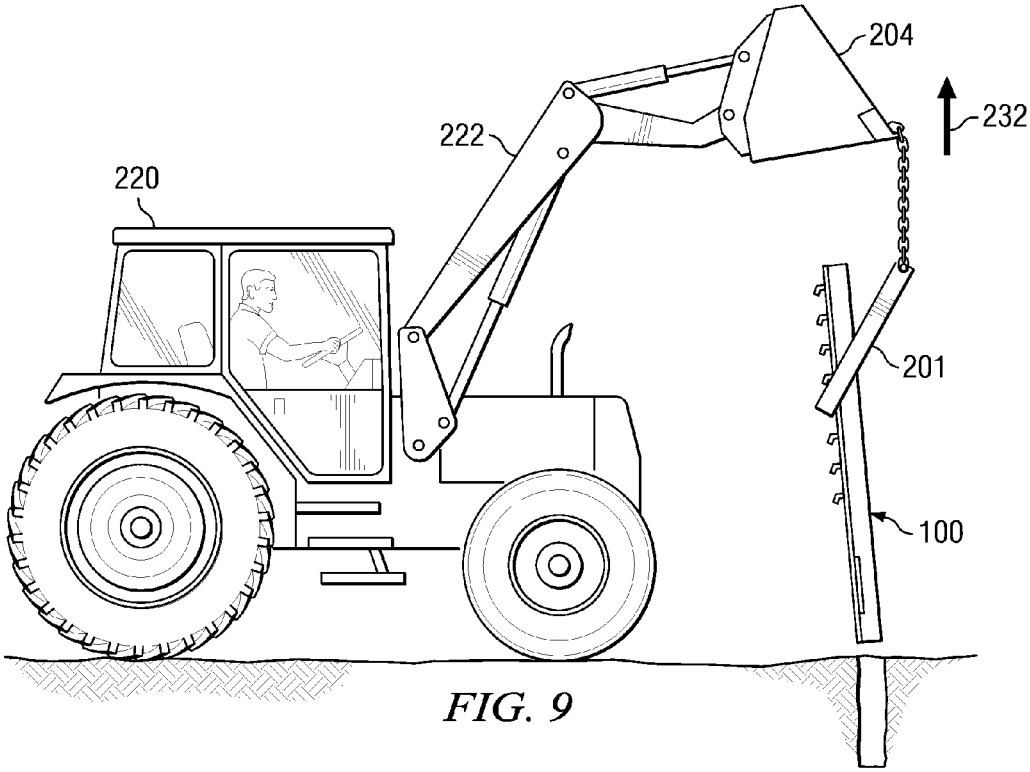
FIGS. 9-11 illustrate the final steps of a method of pulling a fence post from the earth as described herein.

Turning to FIG. 9, the operator of tractor 220 then raises lift-arm 222 and bucket 204 in the direction indicated by arrow 232 to pull post 100 from the earth. As the lift-arm 222 is raised, the vertical force exerted on plate 201 is translated into a rotational force, causing the plate to engage post 100 more firmly. As long as the lower end of post 100 is embedded in the earth, plate 201 cannot rotate and as the vertical force is increased, the force holding the post in engagement with the plate increases until the post is extracted from the earth. As post 100 is extracted from the earth, the force exerted on the post by plate 201 decreases as the lower end of the post becomes free. In many instances post 100 will then fall out of plate 201 under the force of gravity, allowing the operator to maneuver tractor 220 to the next post to be extracted.

Figure 10:
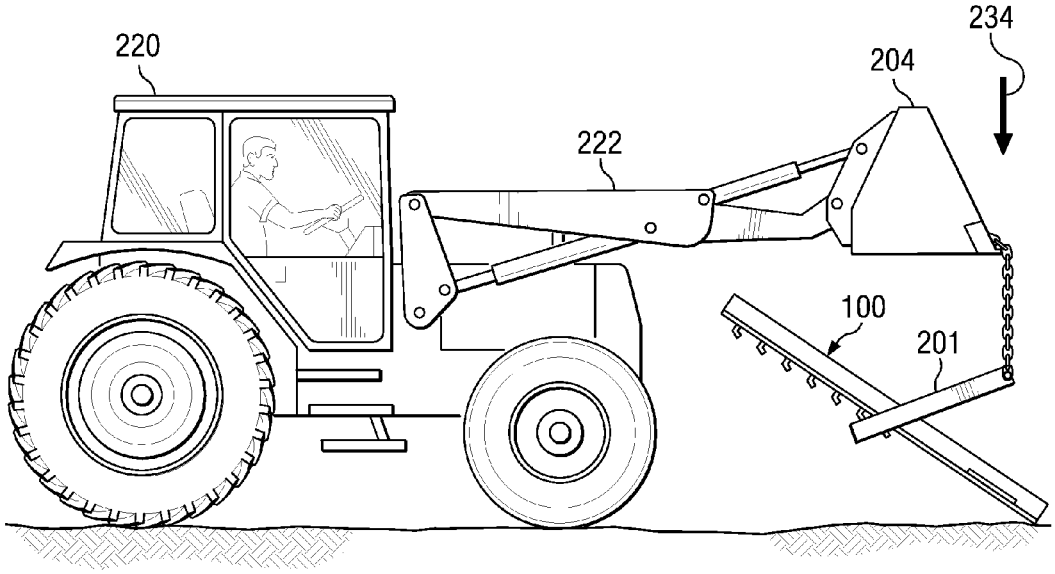
Figure 11:
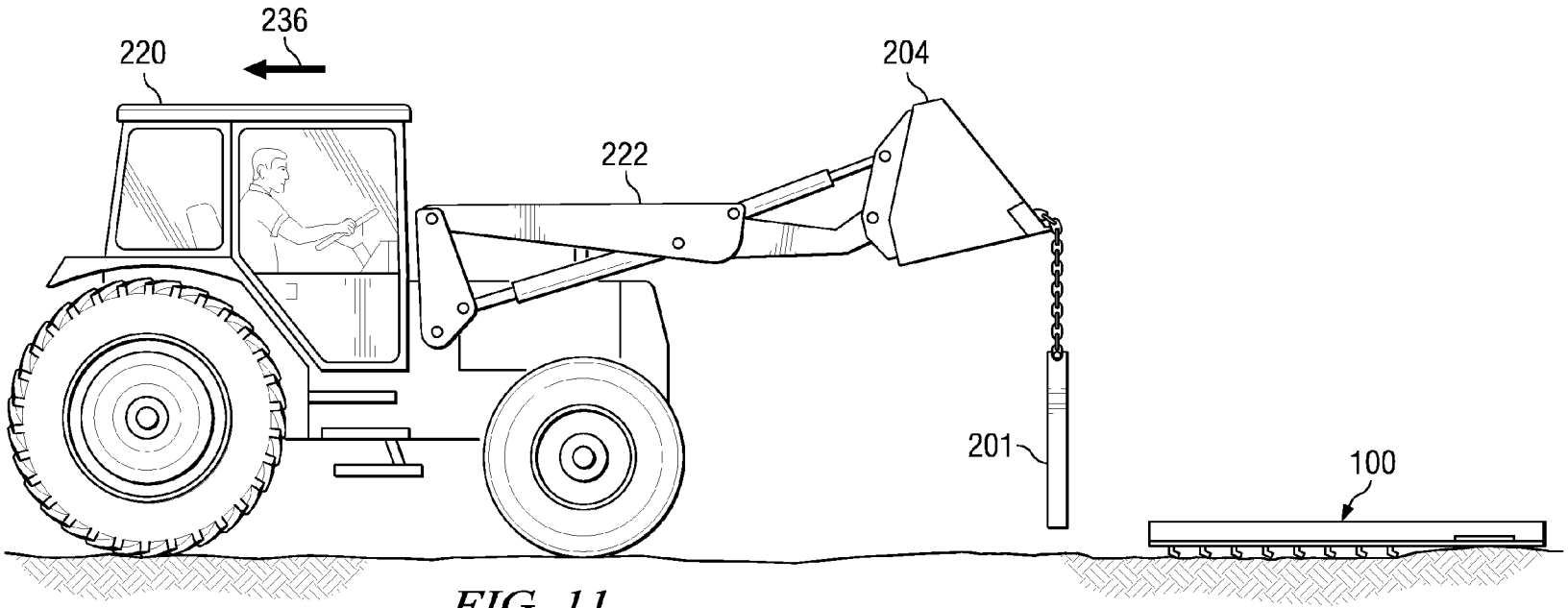

Turning to FIGS. 10 and 11, if post 100 does not fall out of plate 201 under the force of gravity, in order to disengage post from the plate, the operator of tractor 220 lowers lift-arm 222 and bucket 204 in the direction indicated by arrow 234 to disengage the post. If post 100 does not immediately disengage from plate 201, the operator may move the tractor 220 in the direction indicated by arrow 236 of FIG. 11, at which time the post 100 will slide out of opening 208 and fall to the earth.

It will be appreciated that the method described above in connection with FIGS. 4-11 is accomplished without the operator being required to dismount tractor 220 or rely on a helper to engage apparatus 200 or another device with a post 100 to be extracted. Consequently a plurality of posts 100 may be sequentially extracted from the earth rapidly with a minimum of labor.

Figure 12:
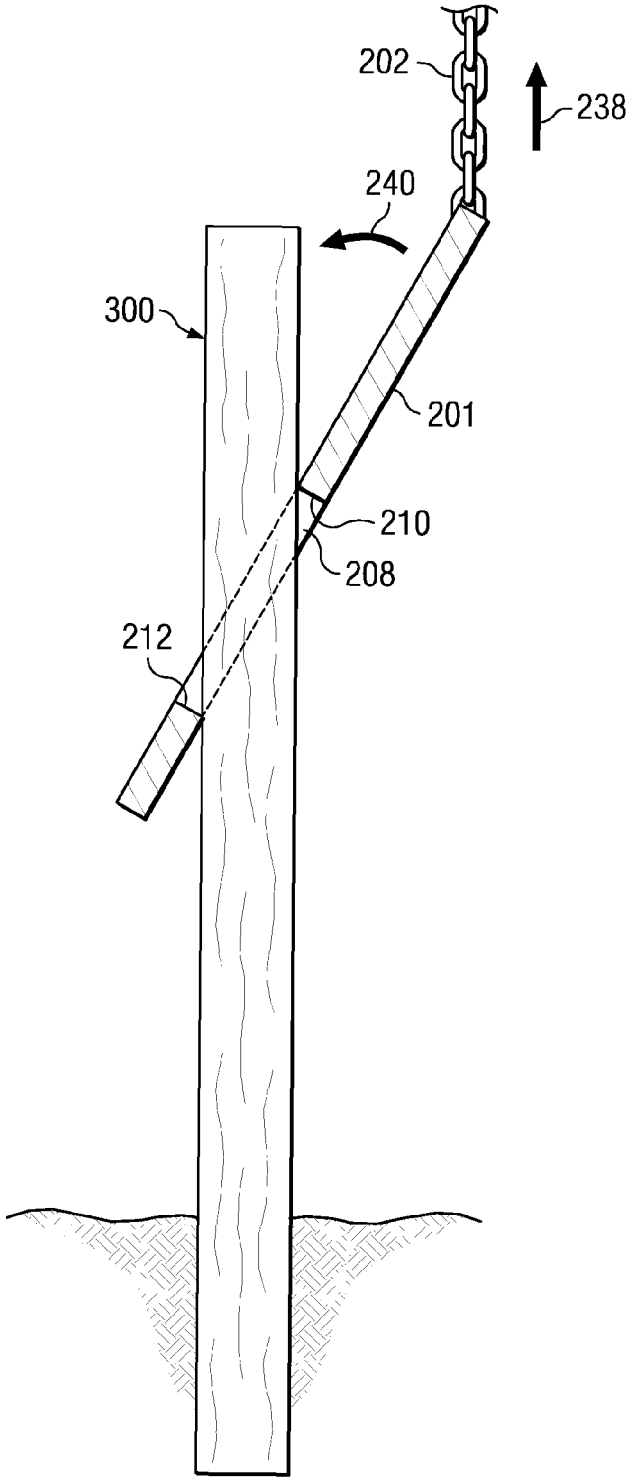
FIG. 12 illustrates the post-pulling apparatus of FIGS. 2 and 3 engaged with a wooden fence post.

Although the foregoing method has been described in connection with the extraction of T-type steel fence posts from the earth, it will be appreciated that the method may be employed with other types of rigid, elongate objects embedded in the earth. As illustrated in FIG. 12, apparatus 200 may be used on wooden fence post 300. As illustrated, the upper wall 210 of opening 208 engages a first side of post 300 while the lower wall 212 of the opening engages an opposing side of the post. As plate 201 is raised in a vertical direction with a piece of mobile equipment as indicated by arrow 238 the vertical force applied to the plate is translated to a rotational force as indicated by arrow 240. Since the lower end of post 300 is embedded in the earth, the rotational force causes the post 300 to be squeezed or pinched in opening 208 of plate 201 as the plate attempts to rotate to a vertical orientation. As more force is applied, the grip of plate 201 on post 300 increases until the post is extracted from the earth. While not necessary in many cases, serrations or teeth 214 (FIG. 3) may be particularly useful in engaging post 300 to prevent plate 201 from slipping on post 300 as the post is extracted from the earth.

It will be appreciated by those skilled in the art having the benefit of this disclosure that this post-puller and method provides a method and apparatus for extracting T-type fence posts and similar elongate rigid objects from the earth. In accordance with the method, the extraction of the fence posts may be accomplished through the use of a piece of mobile equipment or vehicle having a lift arm without the operator dismounting the vehicle to engage the apparatus with the post or elongate object.

It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A method of removing a rigid elongate object from the earth, with a human operated, powered mobile vehicle having a lift arm, the rigid elongate object having a first portion embedded in the earth and a second portion protruding from the earth comprising:

a) moving the powered mobile vehicle into proximity to the rigid elongate object with a substantially flat plate attached to the lift arm of the powered mobile vehicle, the flat plate having an inward facing surface and an outward facing surface and a rectangular opening having a top wall, a bottom wall and a width substantially greater than a width of a cross-section of the rigid elongate object, wherein the flat plate hangs vertically from the lift arm and can move in an arc relative to the lift arm and into proximity with the rigid elongate object;

b) moving the powered vehicle in a first direction to cause the respective inward or outward surface of the flat plate to contact the rigid elongate object and project the upper end of the rigid elongate object through the rectangular opening in the plate;

c) lowering the lift arm such that the plate slides down the length of the rigid elongate object until the top wall of the rectangular opening is below an upper end of the rigid elongate object with the flat plate in a tilted configuration relative to the plane of the axis of the rigid elongate object; and d) raising the lift arm and the flat plate whereby the top and bottom walls of the rectangular opening engage opposite sides of the rigid elongate object with sufficient force to retain the rigid elongate object in the rectangular opening when upward force by the lift arm is applied to the flat plate to pull the rigid elongate object from the earth.

2. The method of claim 1 further comprising lowering the lift arm such that a lower end of the rigid elongate object contacts the earth whereby the top and bottom walls of the rectangular opening disengage the rigid elongate object.

3. The method of claim 2 further comprising raising the lift arm whereby the rigid elongate object is disengaged from the rectangular opening and the flat plate.

4. The method of claim 2 further comprising moving the powered mobile vehicle to move in a second direction to disengage the rigid elongate object from the rectangular opening.

5. The method of claim 1 further comprising attaching the plate to the lift arm with one of a chain, cable or rope.

6. A method of removing a T-type fence post embedded in the earth with a powered mobile piece of equipment controlled by a human operator, wherein a portion of the fence post projects from the earth, the method comprising:

a) attaching a substantially flat plate to a lift arm of the powered mobile piece of equipment such that the plate hangs substantially vertically from the lift arm and can move in an arc relative to the lift arm, the plate having a rectangular opening therethrough, the rectangular opening having a top wall and a bottom wall, and the rectangular opening having a width being substantially greater than a width of a cross-section of the T-type fence post, the flat plate having an inward facing surface and an outward facing surface;

b) moving the powered mobile piece of equipment in a first direction to cause the respective inward or outward surface of the flat plate to contact the T-type fence post and project the upper end of the T-type fence post through the rectangular opening in the flat plate whereby the flat plate is tilted relative to the plane of the axis of the flat plate;

c) lowering the lift arm to slide the flat plate down the length of the T-type fence post a desired distance; and d) raising the lift arm until the flat plate engages a stud projecting from the T-type fence post with the bottom wall of the rectangular opening and engaging the flange of the T-type fence post with the top wall of the opening with sufficient force to retain the post in the opening when the T-type fence post is pulled from the earth.

7. The method of claim 6 further comprising moving the powered mobile piece of equipment in a second, reverse direction after engaging the stud such that the bottom wall of the rectangular opening engages the stud of the T-type fence post and the top wall engages the flange of the post with sufficient force to retain the T-type fence post in the opening as the T-type fence post is pulled from the earth.

8. The method of claim 6 further comprising lowering the lift arm such that a lower end of the T-type fence post contacts the earth whereby the top and bottom walls of the rectangular opening disengage the rigid elongate object.

9. The method of claim 8 further comprising moving the powered mobile vehicle to move in a second direction to release the T-type fence post object from the rectangular opening.

10. The method of claim 6 further comprising attaching the plate to the lift arm with one of a chain, cable or rope.

11. The method of claim 6 further comprising lowering the lift arm after an upper end of the T-type fence post enters the rectangular opening in the plate such that the plate slides down over the T-type fence post under the force of gravity.

12. The method of claim 6 further comprising attaching the plate to the lift arm of the powered mobile piece of equipment with one of a chain, cable or rope.

13. A method of removing a rigid elongate object from the earth with a powered mobile vehicle controlled by a human operator, the rigid elongate object having a first portion embedded in the earth and a second portion projecting from the earth, the method comprising:

a) moving the powered mobile vehicle in a first direction to contact the rigid elongate object with a substantially flat plate attached to a lift arm of the powered mobile vehicle and project an upper end of the elongate object through a rectangular opening in the substantially flat plate, the rectangular opening having a top wall and a bottom wall, and a width being substantially greater than a width of a cross-section of the rigid elongate object, and wherein the plate is attached to a lift arm of the powered mobile vehicle with one of a chain, cable or rope such that the plate hangs vertically from the lift arm under the force of gravity and can move in an arc relative to the lift arm upon contact with the rigid elongate object such that the axis of the flat plate is tilted relative to the elongate rigid object;

b) raising the flat plate with the lift arm to engage a first side of the rigid elongate object with the bottom wall of the opening and engaging a second, opposed side of the rigid elongate object with the top wall of the rectangular opening with sufficient force to retain the rigid elongate object in the opening as the lift arm is raised to pull the elongate object from the earth; and c) lowering the lift arm such that a lower end of the rigid elongate object contacts the earth whereby the top and bottom walls of the rectangular opening disengage the rigid elongate object whereby the flat plate may be disengaged from the rigid elongate object by raising the lift arm.

14. The method of claim 13 further comprising moving the powered mobile vehicle in a reverse direction after positioning the flat plate over the rigid elongate object such that the bottom wall of the rectangular opening engages a first side of the rigid elongate object and the top wall engages an opposed, second side of the rigid elongate object with sufficient force to retain the rigid elongate object in the opening and pulling the rigid elongate object from the earth.

15. The method of claim 13, wherein the rigid elongate object is one of a steel or wooden fence post.

* * * * *